United States Patent [19]

Kent

[11] Patent Number: 4,555,234

[45] Date of Patent: Nov. 26, 1985

[54] FLOTATION VEST CONSTRUCTION

[75] Inventor: David Kent, Guelph, Canada

[73] Assignee: Guelph Elastic Hosiery Company Limited, Guelph, Canada

[21] Appl. No.: 709,200

[22] Filed: Mar. 7, 1985

Related U.S. Application Data

[63] Continuation of Ser. No. 536,377, Sep. 27, 1983, abandoned.

[51] Int. Cl.[4] ..... B63C 9/08

[52] U.S. Cl. ..... 441/106; 441/108; 441/112; 441/116

[58] Field of Search ..... 267/144, 167; 441/88, 441/108, 111, 112, 114, 115, 116, 117, 118, 125–127; 405/186; 2/2.5, 2.1 A, 81; 493/356, 396, 397, 399, 405, 408

[56] References Cited

U.S. PATENT DOCUMENTS

| | | | |
|---|---|---|---|
| 3,323,151 | 6/1967 | Lerman | 441/106 |
| 4,281,428 | 8/1981 | Rochlin | 441/106 |
| 4,380,441 | 4/1983 | Harr | 441/117 |

*Primary Examiner*—Trygve M. Blix
*Assistant Examiner*—Edwin L. Swinehart
*Attorney, Agent, or Firm*—Sim & McBurney

[57] ABSTRACT

A flotation vest includes a back panel and two front panels joined to the lower sides of the back panel. Each front panel includes a lapel portion which extends upwardly to join the back panel at an upper corner. An armhole is defined between each front panel and the back panel, adjacent the respective lapel portion. Each front panel includes two layers of fabric defining between them a pocket which extends continuously through the front panel including the respective lapel portion. Flotation material is provided in each pocket, the flotation material including a plurality of independent sheets of buoyant, flexible material in each pocket below the respective lapel portion, and a single sheet of buoyant, flexible material in the respective lapel portion, the single sheet being folded to provide a plurality of juxtaposed layers connected at folds. In this manner, the folds prevent interleaving of the independent sheets with the folded single sheet.

7 Claims, 3 Drawing Figures

FLOTATION VEST CONSTRUCTION

This is a continuation of U.S. patent application Ser. No. 536,377, entitled "FLOTATION VEST CONSTRUCTION", filed Sept. 27, 1983 now abandoned.

This invention relates generally to life preservation devices, and has particularly to do with a flotation vest construction consisting of cut and sewn fabric material defining one or more pockets in which a buoyant, flotation material can be retained.

BACKGROUND OF THIS INVENTION

Many flotation vest constructions are known in the prior art, and the following patents are exemplary:
U.S. Pat. No. 4,167,051, Galecke, Sept. 11, 1979;
U.S. Pat. No. 3,540,067, Deruaz, Nov. 17, 1970;
U.S. Pat. No. 3,545,017, Cohn, Dec. 8, 1970.

All of these vest constructions are acceptable in terms of function, but the complexity of the stitch-lines, the plurality of the pockets, or the requirement for large sheets of buoyant material with complicated outlines, renders these prior art devices costly to produce, and therefore not competitive in the marketplace.

In terms of the economies of manufacturing flotation vests, it is important to understand that there are currently two kinds of foamed plastic which are generally utilized. The more expensive of these is PVC foam, which is relatively soft at a thickness of 1 inch, and can be used in that thickness to provide buoyant inserts for vests. A less expensive material is polyethylene foam, but it is substantially stiffer and more rigid than PVC foam. The polyethylene foam typically comes in boards or sheets of $\frac{1}{4}$ inch thickness. At the thickness of $\frac{1}{4}$ inch, the polyethylene foam is flexible enough to be utilized in vests, but if only $\frac{1}{4}$ inch were provided, there would be insufficient buoyancy to meet regulations. Because of this, economy-minded manufacturers utilize a plurality of such sheets juxtaposed against each other, typically four sheets in a pocket giving an overall thickness of 1 inch.

In a particularly simple vest construction, a roughly rectangular back panel is joined along its lower side edges to two front panels which meet at the centre to provide a zipper connection. Lapel portions extend upwardly and outwardly from the inner upper corners of the front panels to meet the upper outer corners of the back panel.

While it would be possible to provide four identical sheets of $\frac{1}{4}$ inch polyethylene foam juxtaposed against each other in each of the pockets of the front panels, with the sheets cut in such a way as to provide flotation in the front panels and also up along the lapel portions, the odd shape of each of these panels would be very wasteful of material, and the economy-minded manufacturer would not wish to proceed along these lines.

If it should be conceived to provide separate inserts for the front panel and for the lapel portion, problems of loss of position would be encountered, which will be explained more fully in the description portion of this disclosure.

Further prior art of interest is the following:
U.S. Pat. No. 4,047,255 issued Sept. 1977 to Kiefer
U.S. Pat. No. 3,545,017 issued Dec. 1970 to Cohn
U.S. Pat. No. 4,316,286 issued Feb. 1982 to Klein
U.S. Pat. No. 3,323,151 issued June 1967 to Lerman
U.S. Pat. No. 4,281,428 issued Aug. 1981 to Rochlin
U.S. Pat. No. 4,380,441 issued April 1983 to Harr U.S. Pat. No. 2,029,394 issued Feb. 1936 to Sidebotham
U.S. Pat. No. 3,434,399 issued March 1969 to Palmer.

GENERAL DESCRIPTION OF THIS INVENTION

Accordingly, it is an object of an aspect of this invention to provide a flotation vest of simple construction with a minimum of stitch lines and adapted to use plural sheets of polyethylene foam without wastage in the cutting of the foam, in such a way that the foam inserts remain in place.

More particularly, this invention provides a flotation vest comprising a back panel, two front panels joined to the lower sides of the back panel, each front panel including a lapel portion extending upwardly to join the back panel at an upper corner thereof, each front panel defining with the back panel an armhole adjacent the respective lapel portion, each front panel having two layers of fabric defining between them a pocket extending continuously through the front panel including the respective lapel portion, and flotation material in each such pocket, said flotation material including:

a plurality of layers of buoyant, flexible material in each pocket below the respective lapel portion, and a single sheet of buoyant, flexible material in the respective lapel portion, said single sheet being gated by means of a plurality of substantially parallel, spaced-apart slits which extend short of the edges of the sheet, each slit passing entirely through the sheet so that the sheet remains joined only beyond the extremities of each slit, whereby the sheet folds preferentially at said slits, said single sheet being folded to provide a plurality of juxtaposed layers connected at folds, whereby the folds prevent interleaving of said layers with said folded single sheet.

GENERAL DESCRIPTION OF THE DRAWINGS

One embodiment of this invention is illustrated in the accompanying drawings, in which like numerals denote like parts throughout the several views, and in which:

FIG. 1 is a front view of a flattened flotation vest constructed in accordance with this invention;

FIG. 2 parts (a), (b) and (c) show three stages in the assembly of one of the flotation components of the vest of FIG. 1; and FIG. 3 shows a somewhat exploded view of all flotation components in one half of the front portion of the flotation vest of FIG. 1.

DETAILED DESCRIPTION OF THE DRAWINGS

Figure 1:
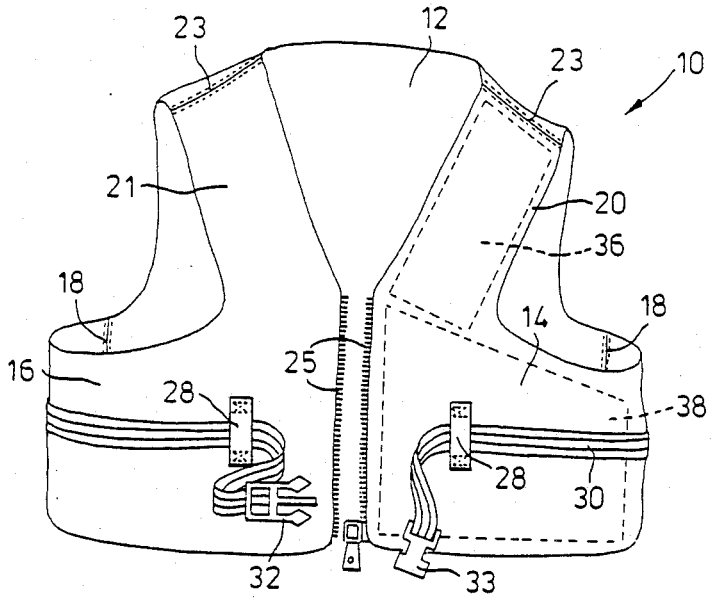

Attention is first directed to FIG. 1, which shows a flotation vest generally at 10, which includes a back panel 12, a left front panel 14, and a right front panel 16, each front panel being joined to one of the lower sides of the back panel 12 at a stitch line 18. Each front panel 14, 16 includes a lapel portion 20, 21, respectively, each lapel portion extending upwardly and outwardly from the inner upper corner of the front panel to join the back panel at an upper outer corner thereof, these being stitched together at the lines 23.

Each front panel 14, 16 defines with the back panel 12 an armhole which is adjacent the respective lapel portion, as can be clearly seen in FIG. 1.

Along the inner edges of the front panels 14, 16 are provided zipper components 25 of standard construction.

The vest 10 includes a plurality of belt loops of which two can be seen in FIG. 1 at 28. Through the belt loops 28 is threaded a belt 30 of conventional construction, including snap-buckle components 32 and 33 of known construction.

Aside from stitch lines around the margins of the various panels and portions already described, the only additional stitch lines between the major panels are those shown at 18 and 23. This results in a reduced expense for manufacture.

All panels, including the lapel portions 20 and 21 are defined by two layers of fabric which define between them a pocket. More particularly, the two layers of fabric defining each front panel 14, 16 and its respective upwardly extending lapel portion 20, 21 provide a pocket extending continuously throughout the front panel including its lapel portion. As pointed out previously in this specification, it would be possible to cut a block or sheet of flotation material in such a way that it conformed with the odd outline of the continuous pocket within each front panel. However, this particular shape would result in much wastage of material, and should be avoided if possible. Where cost is not an object, of course, such die cutting and the accompanying wastage is acceptable.

However, it is desired here to minimize such wastage, and furthermore to allow the use of the stiffer polyethylene foam in sheets of ¼ inch thickness, while not requiring any additional stitch lines.

Looking again at FIG. 1, there is shown in broken lines an upper rectangular insert 36 of buoyant flotation material, and a lower trapezoidal insert 38 of buoyant flotation material. As previously mentioned, a single thickness of ¼ inch polyethylene foam would not provide sufficient flotation for the vest construction shown in FIG. 1, and therefore a multiplicity of layers, typically four, must be provided. However, if one were simply to provide four independent rectangular sheets at the location of the insert 36, and four additional trapezoidal sheets at the location of the insert 38 in FIG. 1, it is evident that the independent sheets in the lapel portion 20 would simply fall down into the lower space occupied by the trapezoidal sheets, either interleaving with the lower sheets, or falling down to the inside or the outside thereof. Of course, one way of preventing this undesirable consequence would be to provide another stitch line between the upper and lower insert locations. However, every stitch line represents an additional expense, and is to be avoided if possible.

The solution to this problem provided herein is to make the upper insert 36 in the form of a single rectangular sheet of ¼ inch polyethylene foam, and to fold the sheet to provide a plurality (preferably four) of juxtaposed layers connected at folds. Then, the lower insert 38 can be provided in the form of a plurality of independent, separate trapezoidal sheets. It is evident from the configuration of FIG. 1 that the lower sheets will remain in place, both because of their shape and due to gravity, and it will be understood that the folds between the joined juxtaposed panels of the upper insert 36 will prevent interleaving of the lower independent sheets with the folded single sheet.

Figure 2:
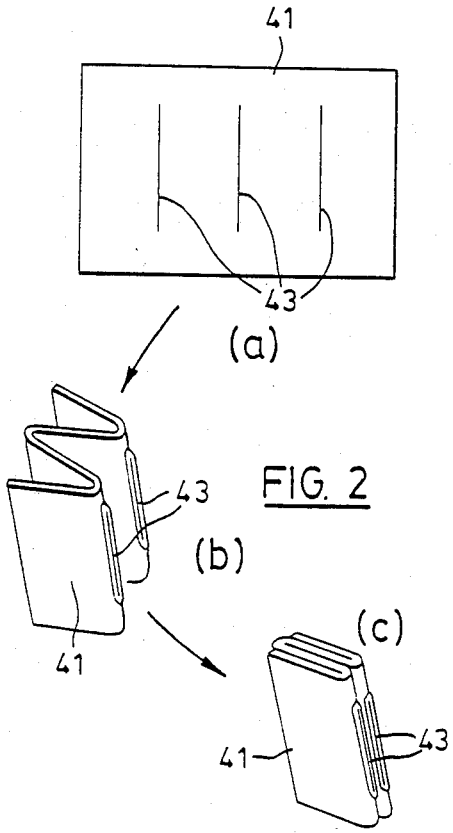

FIG. 2(*a*) shows a rectangular sheet 41, prior to folding to provide the insert 36. The sheet 41 is cut to provide three substantially parallel, spaced-apart slits 43, the slits 43 not extending to the upper and lower edges of the sheet. The provision of the slits 43 is sometimes called "gating", and it will be evident that the thus gated sheet 41 will fold preferentially along fold lines coincident with the slits 43. FIG. 2(*b*) shows an intermediate step in the folding or accordionation of the sheet 41, while FIG. 2(*c*) shows the sheet 41 fully folded together. Because of the resilience of the polyethylene foam of which the sheet 41 is made, the folded-together component shown in FIG. 2(*c*) will tend to open up, but will be prevented from doing so by the fabric material defining the pocket within the lapel portion 20, 21 of the jacket shown in FIG. 1. However, this tendency to try to open up will further prevent the upper insert in the lapel portion from falling down beside the independent trapezoidal sheets in the lower pocket.

Figure 3:
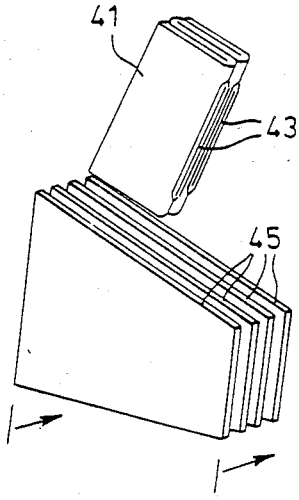

FIG. 3 shows a plurality of independent trapezoidal sheets 45 in slightly exploded position, it being understood that these sheets would be collapsed together to be inserted into the pocket defined at the bottom of a front panel 14, 16 of the vest. Above the trapezoidal sheets 45 is illustrated the sheet 41 in its folded condition.

It will now be apparent that a particularly advantageous and low-cost construction has been provided for a flotation vest. The rectangular sheets 41 can be cut very economically from the larger sheets in which such material is normally provided. Also, because of the trapezoidal form of the sheets 45 (FIG. 3), these too can be economically cut from larger sheets without any wastage. Hence, odd shapes are avoided, and also the necessity for providing separating stitch lines between the upper and lower parts of the front panel is also avoided.

While one embodiment of this invention has been illustrated in the accompanying drawing and described in the foregoing disclosure, it will be evident to those skilled in the art that changes and modifications may be made therein without departing from the essence of this invention, as set forth in the appended claims.

What I claim is:

1. A flotation vest comprising a back panel, two front panels joined to the lower sides of the back panel, each front panel including a lapel portion extending upwardly to join the back panel at an upper corner thereof, each front panel defining with the back panel an armhole adjacent the respective lapel portion, each front panel having two layers of fabric defining between them a pocket extending continuously through the front panel including the respective lapel portion, and flotation material in each such pocket, said flotation material including:

a plurality of layers of buoyant, flexible material in each pocket below the respective lapel portion, and a single sheet of buoyant, flexible material in the respective lapel portion, said single sheet being gated by means of a plurality of substantially parallel, spaced-apart slits which extend short of the edges of the sheet, each slit passing entirely through the sheet so that the sheet remains joined only beyond the extremities of each slit, whereby the sheet folds preferentially at said slits, said single sheet being folded to provide a plurality of juxtaposed layers connected at folds, whereby the folds prevent interleaving of said layers with said folded single sheet.

2. The invention claimed in claim 1, in which the buoyant, flexible material is flotation grade polyethylene foam.

3. The invention claimed in claim 2, in which said single sheet is rectangular, and in which the polyethylene foam is $\frac{1}{4}$ inch thick.

4. The invention claimed in claim 3, in which there are three slits defining four panels, and in which there are four independent sheets in each pocket below the lapel portion.

5. The invention claimed in claim 1, in which the back panel has two layers of fabric defining a further pocket, said further pocket containing buoyant, flexible material.

6. The invention claimed in claim 5, in which the vest includes means for securing the front panels together.

7. The invention claimed in claim 1, in which the material in said further pocket is rectangular, and the material in the pocket of each front panel below the respective lapel portion is trapezoidal.

* * * * *